428-911
3/10/87 XR 4,648,136

United States Patent [19]

Higuchi

[11] Patent Number: 4,648,136

[45] Date of Patent: Mar. 10, 1987

[54] HUMAN BODY PROTECTOR

[75] Inventor: Susumu Higuchi, Abiko, Japan

[73] Assignee: C. Itoh & Co., Ltd., Osaka, Japan

[21] Appl. No.: 870,711

[22] Filed: Jun. 4, 1986

[51] Int. Cl.[4] ..... F41H 1/02
[52] U.S. Cl. ..... 2/2.5; 428/911
[58] Field of Search ..... 2/2.5; 428/911

[56] References Cited

U.S. PATENT DOCUMENTS

| | | | |
|---|---|---|---|
| 1,021,804 | 4/1912 | Schneider | 2/2.5 X |
| 1,268,223 | 6/1918 | Eimer | 2/2.5 |
| 1,282,411 | 10/1918 | Golembiowski | 2/2.5 X |
| 1,290,799 | 1/1919 | Talley | 2/2.5 X |
| 1,532,362 | 4/1925 | Bailey | 2/2.5 X |
| 2,819,759 | 1/1958 | Goodloe | 2/2.5 X |
| 3,783,449 | 1/1974 | Davis | 2/2.5 |

FOREIGN PATENT DOCUMENTS

| | | | |
|---|---|---|---|
| 0595979 | 4/1934 | Fed. Rep. of Germany | 2/2.5 |
| 0002889 | of 1900 | United Kingdom | 2/2.5 |

OTHER PUBLICATIONS

The Washington Post; p. A14; Jan. 4, 1962; "Army's Armored Vest".

*Primary Examiner*—Louis K. Rimrodt
*Attorney, Agent, or Firm*—McAulay, Fields, Fisher, Goldstein & Nissen

[57] ABSTRACT

A human body protector comprising a front layer and a rear layer. In this protector, each layer is comprised of a plurality of segments having a regular hexagon shape and arranged by placing circumferential edges of adjacent segments in contact with each other in a state wherein spaces between the adjacent segments are substantially eliminated, and joining lines between the adjacent segments of one layer are covered by the segments of the other layer, and through apertures at the joining points, existing because joining lines of the segments of one layer overlap the joining points of another layer, are closed by a retaining members. The construction of the protector of the present invention provides an excellent protection against penetration of the protector by a sharp pointed blade, such as an ice pick.

8 Claims, 10 Drawing Figures

HUMAN BODY PROTECTOR

BACKGROUND OF THE INVENTION

1. Field of the Invention

The present invention relates to a body protector for protecting a human body from an injury caused during an attack by a knife or the like. More particularly, it relates to a human body protector used as a part of a human body protector vest which police personnel, guards or the like working at a place where there is a probability that they will be exposed to a sudden attack, or a worker usually wearing a knife for work purposes wear.

2. Description of the Related Art

Hitherto, police personnel or the like have worn a bullet proof protector underneath normal clothes to protect themselves from a gunshot wounds, in an emergency, and various bullet proof protectors have been developed and are used.

The bullet-proof property of convential protectors are very satisfactory. Nevertheless, when police personnel or the like are in a dangerous situation, it is actually necessary for the protector to have both bullet-proof and blade-proof properties. A protector having a perfect blade proof function should comprise a continuous and uniform surface, i.e., a slitless protector, but this kind of protector has no flexibility and a poor wearability. Therefore, when a protector having the blade-proof function is made to have a certain flexibility, the protector having the blade-proof function must be constituted of several segments connected to each other. The protector comprised of several segments necessarily has, however, small gaps between each segment and a blade can be pushed through these gaps. Therefore, this type of protector has a poor blade-proof function.

Recently, a proposal for a protector that is bullet-proof and blade-proof was disclosed in Japanese Unexamined Patent Publication (Kokai) No. 58-19700. In this publication, the protector provided with both a bullet proof function and a blade proof function by combining a blade-proof plate-like element having a blade-proof effect against a lethal weapon such as a sword, an ice pick, or the like, with a known bullet-proof textile sheet, was proposed. The blade proof plate-like protector of this invention is comprised of a plurality of blade proof elements spread over the body in one layer and two types of connecting elements connecting the adjacent blade proof elements. In this blade proof plate-like protector, some portions are formed as a two layer construction of the blade-proof elements and the connecting elements, and the other portions have a one layer constitution. Therefore, the blade-proof function of the blade-proof plate-like element acts only in the one layer constitution, and this is not sufficient in an actual dangerous situation, especially when the police personnel or the like are attacked with a pointed blade. e.g., an ice pick.

SUMMARY OF THE INVENTION

It is an object of the present invention to provide a human body protector having a blade-proof function capable of withstanding a penetration action of a sharp pointed blade. e.g., an ice pick, and having a permeability and a body fitting which will enable the protector to be worn in the same condition as for wearing a conventional or regular protector, in all seasons.

The object of the present invention is achieved by a human body protector having a flexibility that makes it capable of fitting the human body, characterized in that the protector comprises a front layer consisting of a group of segments of blade-proof plate having a plurality of connecting apertures and spread over the body by placing the circumferential edges of each segment in contact in a state wherein spaces between the adjacent segments are substantially eliminated, and a rear layer consisting of another group of segments of blade-proof plate made and spread over the body in the same manner as the segments of the front layer. Each of the segments constituting both layers of the present invention is superimposed in a shifting state such that each segment of one layer can cover joining lines between each segment of the opposite layer, respectively, and the front layer and the rear layer are connected in a state wherein they are capable of moving only slightly by inserting retaining members into each connecting aperture at a position in which it corresponds with an aperture in the other layer. Further, in the protector of the present invention other retaining members are inserted of cross points of joining lines of the front layer and of joining lines of the rear layer existing when both layers are superimposed.

As described hereinbefore, since the protector of the present invention is formed in a two layer construction, the joining lines between adjacent segments of one layer are covered by segments of the other layer, and the cross points of the joining lines of the front layer and the joining lines of the rear layer are covered by retaining members having a function sufficient to prevent penetration by a pointed blade, and thus the protector of the present invention has a superior blade-proof function, capable of withstanding penetration by a pointed blade, over the entire surface of the protector.

Further, since each layer is formed by a plurality of segments spread over the body in a state wherein the circumferential edges of each segment are in contact with each other, the protector of the present invention has sufficient flexibility to ensure that the protector will easily and comfortably fit a human body.

Further, since each segment of one layer and the corresponding segments of another layer are connected by a retaining member having a clearance relative to the aperture of the segments of both layers, the blade-proof effect is increased in that a penetrating energy of the blade is dispersed and eliminated by the relative movement of both layers.

As a preferable aspect of the protector of the present invention, a central rib protruding from an outside surface of a segment of the front layer is provided at a portion of that segment covering the joining lines between each segment of the rear layer, and a circumferential rib protruding from the outside surface of the segment of the front layer is provided on circumferential edges of the segments, so that the central rib portion of the segment of the front layer is reinforced by a thick thickness constituted by a thickness of the segment itself and a thickness of the central rib, and the circumferential ribs provide a function of preventing a blade striking at the segment of the front side layer from sliding into the joining line between the segments of the front layer.

To increase the permeability of the protector, it is preferable to provide at least one aperture on the segments of both layers and to provide a central through hole in the retaining members. Further, preferably the segments of the front layer and/or the segments of the rear layer include at least one protrusion for keeping a space between the opposing surfaces of both segments.

DESCRIPTION OF THE PREFERRED EMBODIMENTS

To facilitate understanding of the present invention, the essential technical idea behind a human body protector in accordance with the present invention is described in detail with reference to the attached drawings.

Figure 1A:
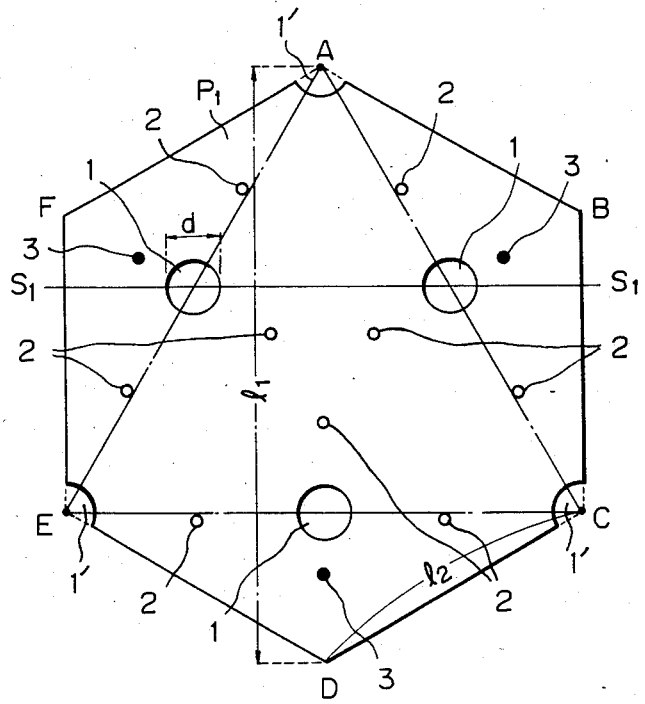
FIG. 1A is a plan view of a blade proof plate segment used in an embodiment of a human body protector in accordance with the present invention, illustrated in FIG. 3.
Figure 1B:
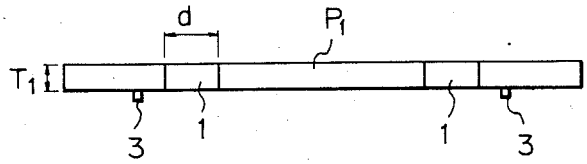
FIG. 1B is a cross section view taken along the line $S_1$—$S_1$ of FIG. 1A.

A blade proof plate segment (hereinafter, simply called the segment) $P_1$ used in an embodiment of a human body protector in accordance with the present invention is shown in FIG. 1A and FIG. 1B. The segment $P_1$ has a regular hexagonal shape formed by six apexes A, B, C, D, E and F in a plane. A distance of a side between one apex and an adjacent apex has a length of 18 mm. A connecting aperture 1 having 3.2 mm in diameter is provided on a middle point of a line $\overline{AC}$, line $\overline{AE}$, and line $\overline{CE}$, respectively. Further, a cut out portion 1' for inserting a retaining member and having a circular arc similar to the circular arc of the connecting aperture 1 is provided on the apexes A, C, and E, respectively. A plurality of holes 2 through which air can pass are provided at optional positions in the segment $P_1$. A plurality of protrusions 3 are provided on a back face of the segment $P_1$ to form a space between a front layer constituted with the plurality of segments $P_1$ and a rear layer constituted with a plurality of segments $P_2$, the constitution of which is similar to the constitution of the segment $P_1$. A distance $l_1$ between the apex A and the apex D has a length of 36 mm. The segment $P_1$ of the front layer is made of a polycarbonate plate having a thickness $T_1$ of 2 mm, and the segment $P_2$ of the rear layer is made of a composite material of 57% Nylon 66 and 43% glass fiber having a thickness of 1.5 mm. The shape in the plane of the segment $P_2$ is the same as the shape of the segment $P_1$, i.e., a regular hexagon.

Figure 3:
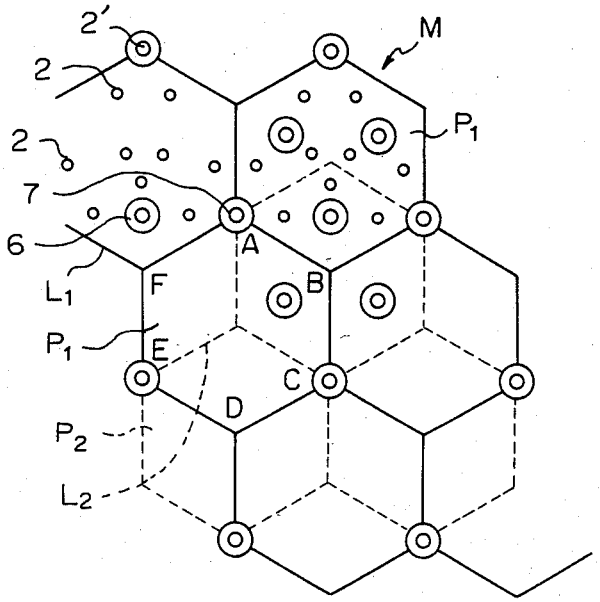
FIG. 3 is a partial plan view illustrating a front face of an embodiment of a human body protector in accordance with the present invention.
Figure 5:
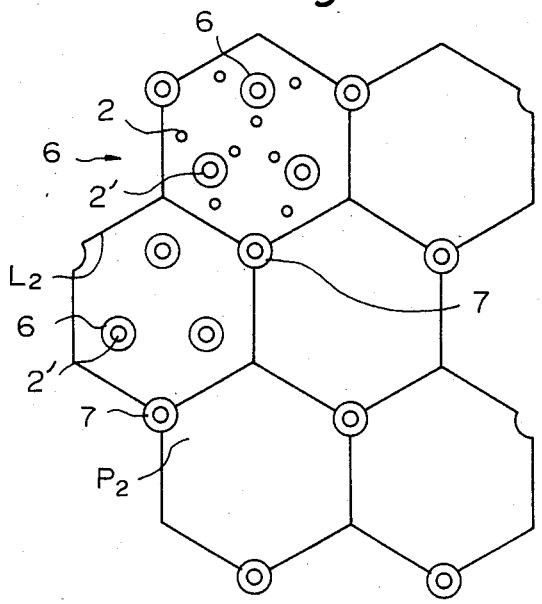
FIG. 5 is a plan view illustrating a rear face of the human body protectors illustrated in FIGS. 3 and 4.

A plurality of segments $P_1$ are arranged by mating circumferential edges of each segment $P_1$ in a state wherein spaces between adjacent segments are $P_1$ substantially eliminated to form a plate like member, i.e., the front layer as shown in FIG. 3. A plurality of segments $P_2$ are also arranged in the same manner as the segments $P_1$ to also form a plate like member, i.e., the rear layer as shown in FIG. 5. In FIG. 3, the segments $P_1$ of the front layer are shown by solid lines and the segments $P_2$ of the rear layer are shown by broken lines, so that the shifting capability of the segments $P_1$ and the segments $P_2$ is clearly shown. Namely, the apexes B, D and F of the segment $P_1$ are positioned at center points of three segments $P_2$, which are in contact with each other, respectively, and the apexes A, C and E of the segment $P_1$ are positioned at points at which the three segments $P_2$ are in contact with each other. Therefore, the points of contact of the three segments $P_1$ and the points of contact of the three segments $P_2$ are located at the same position.

Figure 6:
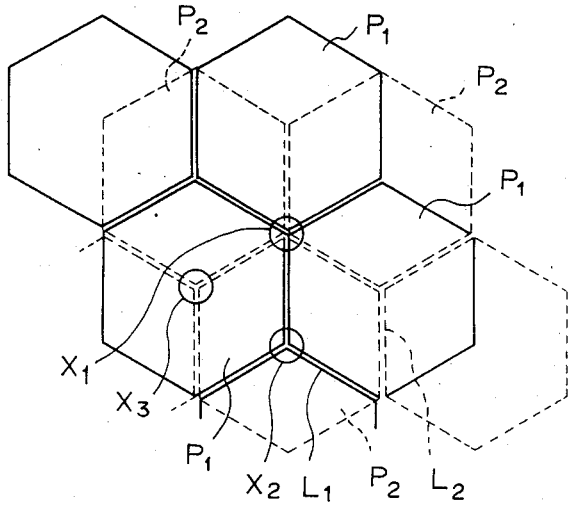
FIG. 6 is an explanatory plan view illustrating a relationship of the connections between adjacent blade proof plate segments.

A relationship between the point of contact of the segment $P_1$ and the point of contact of the segment $P_2$ will now be explained with reference to FIG. 6. To enable a clearer understanding, lines illustrating the profile of each segment are drawn individually in FIG. 6, and therefore, spaces are shown between the adjacent segments. Accordingly, although the plurality of segments are arranged in a state of wherein the spaces therebetween are substantially eliminated as described hereinbefore, in practice a space having a small width is necessarily provided between the adjacent segments and this space is used to give a flexibility to the human body protector. In FIG. 6, the segment $P_1$ of the front layer is also shown by a solid line, and the segment $P_2$ of the rear layer is also shown by a broken line. Each apex of the three segments $P_1$ is in contact at a point $X_1$ in FIG. 6, and each apex of the three segments $P_2$ is in contact at the same point $X_1$ in FIG. 6. Therefore, the point $X_1$ is not covered by any one of the segments $P_1$ and the segments $P_2$. Regarding point $X_2$ in FIG. 6, the three segments $P_1$ are in contact with each other at the point $X_2$, but this point $X_2$ is covered by the segment $P_2$, because the point $X_2$ is located at a center position of the segment $P_2$. Consequently, as can be seen from FIG. 3, all of the joining lines $L_1$, $L_2$ between adjacent segments of the front layer and the rear layer are covered by the opposite segments of the opposite side layer, and the points of contact such as the points $X_2$ and $X_3$ are completely covered by the opposite segment of the opposite side layer, but the points of contact such as the point $X_1$ are not covered by material and there is a through aperture at this point $X_1$.

Figure 7:
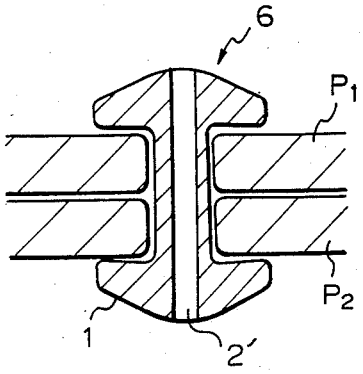
FIG. 7 is an enlarged cross section view of an embodiment of a retaining member connecting a front layer and a rear layer of the human body protector in accordance with the present invention; and, FIG. 8 is a perspective view of an example of a vest with an embodiment of a human body protector in accordance with the present invention, attached thereto.

Before describing a means for closing this through aperture, we will describe a means for connecting the front layer to the rear layer. An example of a retaining member 6 connecting both layers is shown in FIG. 7. An eylet or a rivet having a through aperture may be used as the retaining member 6. The diameter of the through aperture is selected to be small enough that a sharp pointed blade or an ice pick cannot penetrate this through aperture, and this through aperture 2' is used to provide a permeability to the human body protector together with the holes 2 arranged in the segments $P_1$ and $P_2$. The front layer and the rear layer are connected by the retaining member 6, e.g., a rivet, which is inserted and secured to the connecting apertures 1 of the segment $P_1$ and the segment $P_2$, which are arranged in corresponding positions of each segment $P_1$ and $P_2$. As can be understood by comparing FIG. 3 and FIG. 5, the arrangement of the connecting aperture 1 of the segment $P_1$ and the segment $P_2$ has a reverse relationship in the top and bottom direction. In this case, the retaining member 6 may be arranged on both segments $P_1$ and $P_2$ in such a manner that there clearance are formed between the retaining member 6, the segment $P_1$, and the segment $P_2$ to ensure the flexibility of the human body protect as shown in FIG. 7.

The means for closing the above-described through aperture at the point $X_1$ will now be described. In this invention, a retaining member 7 having the same shape as that of the retaining member 6 is used as the means for closing the above-mentioned through aperture. The retaining member 7 is inserted and secured to a through aperture formed by three cut portions arranged at the apexes of the segment and having a circular arc similar to the circular arc of the connecting aperture 1. Since the retaining member 7 is made of a strong material, e.g., iron, steal, or the like, the retaining member 7 can provide protection against penetration by a sharp pointed blade such as an ice pick.

Figure 2A:
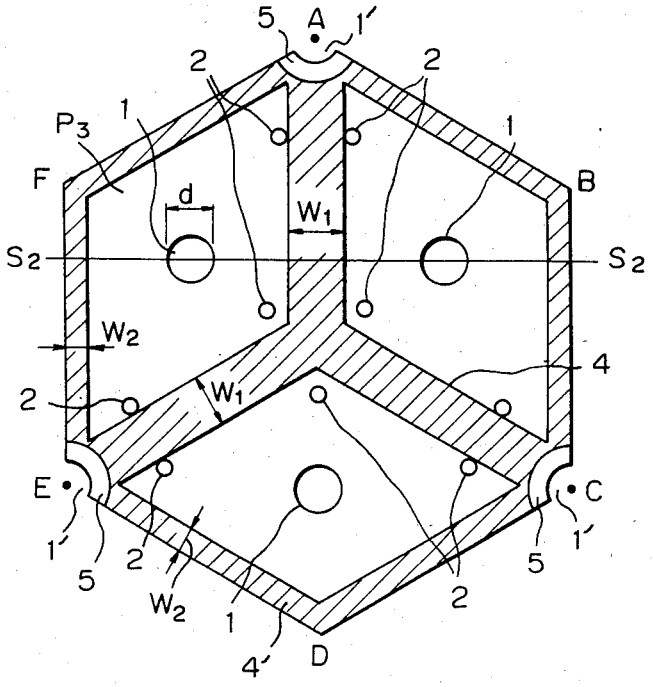
FIG. 2A is a plan view of a blade proof plate segment used in another embodiment of a human body protector in accordance with the present invention, illustrated in FIG. 4.
Figure 2B:
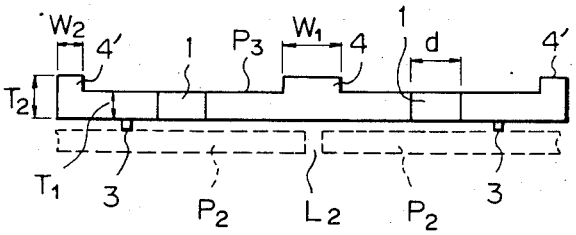
FIG. 2B is a cross section view taken along the line $S_2$—$S_2$ of FIG. 2A.
Figure 4:
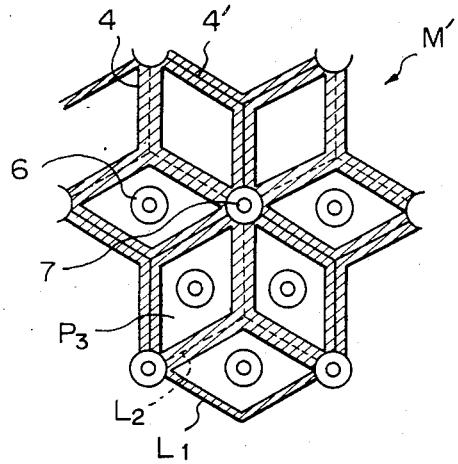
FIG. 4 is a partial plan view illustrating a front face of another embodiment of a human body protector in accordance with the present invention.

Another embodiment of a human body protector in accordance with the present invention will now be described with reference to FIGS. 2A, 2B, and 4. This embodiment differs from the embodiment shown FIGS. 1A, 1B, and 3 in the constitution of the segment used in the front layer; and the constitution of the segment used in the rear layer, the arrangement of the plurality of segments and the connection of both layers are substantially identical to those of the embodiment of the human body protector shown FIGS. 1A, 1B, and 3. As shown in FIGS. 2A and 2B, a segment $P_3$ used as the segment of the front layer includes a central rib 4 protruding from a front surface of the segment $P_3$, having three projections and arranged on the segment $P_3$ in such a manner that it covers the joining line $L_2$ between adjacent segments $P_2$ of the rear layer, and a circumferential rib 4' protruding from the front surface of the segment $P_3$ and arranged on circumferential edges of the segment $P_3$. Further, to prevent interference of the insertion and fixture of the retaining member 6 by the rib 4 or 4', a recess for the retaining member 6 is provided on a portion of both ribs 4 or 4' near to the cut portion 1'.

The segment $P_3$ is made of a polycarbonate material and a thickness $T_2$ at the position provided with the rib 4 and 4' of 3 mm and a thickness $T_1$ at the other positions of 2 mm. The rib 4 has a width $W_1$ of 4 mm, and the rib 4' has a width $W_2$ of 2 mm. The segment 2 of the rear layer illustrated by a broken line in FIG. 2B is made of a composite material of 57% Nylon 66 and 43% glass fiber 2 mm in thickness.

As all of the joining lines $L_2$ of the adjacent segments $P_2$ of the rear layer, illustrated in an exaggerated state in FIG. 2B, are covered by the central ribs 4, this portion has a stronger resistance than the corresponding portion of the segment $P_1$ illustrated in FIGS. 1A and 1B against penetration by a sharp pointed blade or an ice pick. Further when the sharp pointed blade or ice pick strikes at the circumferential edge of the segment $P_3$, the circumferential rib 4' can prevent the sharp pointed blade or ice pick from sliding down the front surface of the segment $P_3$ and slipping in between the circumferential edges of the adjacent segment 3, i.e., joining line $L_1$.

In the above described embodiments, the shape of the segment to be used as an element of the human body protector is described as a regular hexagon. It is apparent, however, that a segment plate having a square shape or the like also may be used for accomplishing the object of the present invention.

Figure 8:
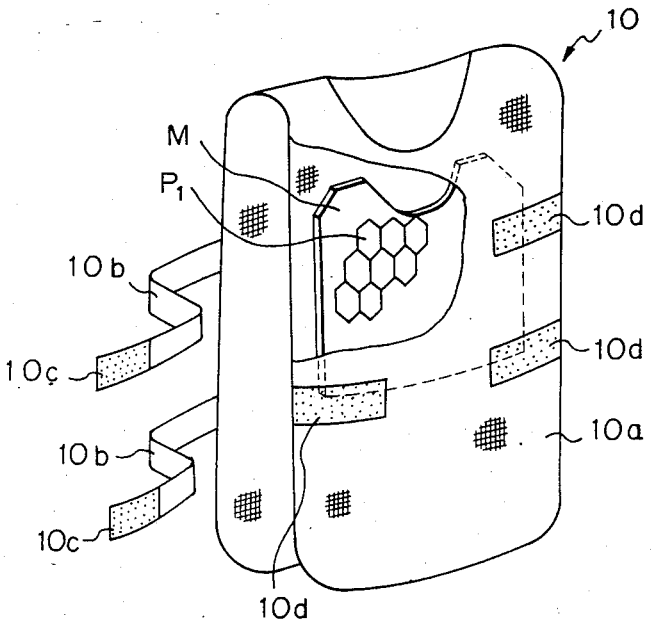

As shown in FIG. 8 illustrating an example of a blade-proof vest 10, the blade proof vest 10 can be manufactured by preparing the human body protector M comprised of the front layer and the rear layer superimposed under the front layer, as described hereinbefore, in a suitable size and covering the member M with a suitable knitted or woven cloth **10*a* having a good permeability. As shown in FIG. 8, the human body protector M is arranged on a breast portion of the vest 10, and two tapes 10*b* each having a magic tape 10*c* at an end portion thereof are attached to a right side and a left side of a back portion of the vest 10, and corresponding magic tapes 10*d* are attached to a right side and a left side of a front portion of the vest 10. The vest 10 can be fitted to a human body by pressing and fixing the magic tapes 10*c* to be corresponding magic tapes 10*d***, respectively.

The blade-proof vest in accordance with the present invention has an excellent blade-proof function against a sharp pointed blade, an ice pick, or the like, and a good flexibility and permeability. When the protrusions are used between both layers, since a space is formed between the layers and the space guarantee the operation of the holes 2 and 2', a suitable permeability is obtained.

I claim:

1. A human body protector having a flexibility making said protector capable of fitting a human body, characterized in that said protector is comprised of a front layer consisting a group of segments ($P_1$) of blade-proof plate having a plurality of connecting apertures (1) and spread over the body by placing circumferential edges of adjacent segments in contact with each other in a state wherein spaces between the adjacent are substantially eliminated, and a rear layer consisting of another group of segments ($P_2$) of blade-proof plate made and spread over the body in the same manner as the segments ($P_1$), and each of said segments constituting both layers being superimposed in a shifting state such that each segment of one layer can cover joining lines ($L_1$ or $L_2$) between each segment of the opposite layer, respectively, the front layer and the rear layer being connected in a state wherein they are capable of moving slightly relative to each other by inserting retaining members (6) into each connecting aperture (1) at a position in which it corresponds with an aperture in the other layer; and the other retaining members (7) being inserted at cross points of joining lines ($L_1$) of the front layer and the joining lines ($L_2$) of the rear layer existing when both layers are superimposed.

2. A human body protector according to claim 1, characterized in that said segments ($P_1$) and said segments ($P_2$) are provided with at least one aperture (2) through which air can pass, respectively, and said segments ($P_1$) and/or said segments ($P_2$) include at least one protrusion for maintaining a space between said segments ($P_1$) and said segments ($P_2$) arranged on opposing surfaces of both segments ($P_1$ and $P_2$).

3. A human body protector according to claim 1, characterized in that said segments ($P_1$) and said segments ($P_2$) have a shape of a regular hexagon and are the same size.

4. A human body protector according to claim 1, characterized in that said retaining members (6 and 7)

include a through hole arranged at a center position thereof.

5. A human body protector having a flexibility making said protector capable of fitting the human body, characterized in that said protector is comprised of a front layer consisting of a group of segments ($P_3$) of blade-proof plate having a plurality of connecting apertures (1) and spread over the body by placing circumferential edges of each segment in contact with each other in a state wherein spaces between adjacent segments are substantially eliminated, and a rear layer consisting of another group of segments ($P_2$) of blade-proof plate having a plurality of connecting apertures (1) and spread over the body by placing circumferential edges of each segment in contact with each other in a state wherein spaces between adjacent segments are substantially eliminated; and each segment constituting both layers being superimposed in a shifting state such that each segment of one layer can cover joining lines ($L_1$ or $L_2$) between each segment of the opposite layer, respectively; a central rib (4) protruding from a front surface of the segment ($P_3$) of the font layer being provided at a position of the segment ($P_3$) at which it can cover the joining lines ($L_2$) between adjacent segment ($P_2$) of the rear layer, and a circumferential rib (4') protruding from the outside surface of the segments (3) being provided on circumferential edges of the segments (3); the font layer and the rear layer being connected in a state wherein they are capable of moving slightly relative to each other by inserting retaining members (6) into each connecting aperture (1) at a position in which it corresponds with an aperture in the other layer; and the other retaining members (7) being inserted at cross points of joining lines ($L_1$) of the front layer and joining lines ($L_2$) of the rear layer are existing when both layers are superimposed.

6. A human body protector according to claim 5, characterized in that said segments ($P_3$) and said segments ($P_2$) are provided with at least one aperture (2) through which air can pass, respectively, and said segments ($P_3$) and/or said segments ($P_2$) include at least one protrusion for maintaining a space between said segments ($P_3$) and said segments ($P_2$) arranged on opposing surfaces of both segments ($P_1$ and $P_2$).

7. A human body protector according to claim 5, characterized in that said segments ($P_3$) and said segments ($P_2$) have a shape of a regular hexagon and are the same size.

8. A human body protector according to claim 5, characterized in that said retaining members (6 and 7) include a through hole arranged at a center position thereof.

* * * * *

UNITED STATES PATENT AND TRADEMARK OFFICE

CERTIFICATE OF CORRECTION

PATENT NO. : 4,648,136

DATED : March 10, 1987

INVENTOR(S) : Susumu HIGUCHI

It is certified that error appears in the above—identified patent and that said Letters Patent is hereby corrected as shown below:

On the Title Page:

Please enter the following:

--Priority is claimed from Japanese Patent Application No. 60-179289, filed August 16, 1985.--

Signed and Sealed this

Eighth Day of September, 1987

*Attest:*

*Attesting Officer*

DONALD J. QUIGG

*Commissioner of Patents and Trademarks*